United States Patent [19]

Hackwell et al.

[11] 4,347,943

[45] Sep. 7, 1982

[54] CONTAINERS

[75] Inventors: Roger E. Hackwell, Saffron Walden; Philip D. Gale, Gidea Park, Romford; Eric K. L. Mason, Colchester, all of England

[73] Assignee: National Plastics Limited, London, England

[21] Appl. No.: 254,057

[22] Filed: Apr. 14, 1981

[51] Int. Cl.[3] ..... B65D 41/16; B65D 41/18

[52] U.S. Cl. ..... 220/306; 220/284; 150/0.5; 215/320

[58] Field of Search ..... 220/306, 308, 284; 150/0.5; 215/317, 320

[56] References Cited

U.S. PATENT DOCUMENTS

| | | | |
|---|---|---|---|
| 4,166,548 | 9/1979 | Crisci | 220/284 |
| 4,245,754 | 1/1981 | Ellis | 220/306 X |
| 4,289,252 | 9/1981 | Helms | 220/308 |
| 4,293,080 | 10/1981 | Letica | 220/306 |
| 4,305,535 | 12/1981 | Brundige et al. | 220/306 X |

*Primary Examiner*—George T. Hall

*Attorney, Agent, or Firm*—Eugene E. Renz, Jr.

[57] ABSTRACT

A container with a lid has a base, a side wall and an open top which the lid closes. It is made by separately moulding in plastics the base and the ring defining the open top, with the side wall being moulded integrally with one or both of these parts, and then joining the parts together by bonding or welding. The top ring is moulded with a flange which extends inwardly and downwardly and receives a mating closure flange on the lid to give a resilient sealing fit.

The lid may be a snap-on fit having a skirt with an inward bead or groove for engaging a complementary groove or bead on the container. The skirt may be accommodated in a rebate at the top of the container and may be levered away from the lower shoulder of the rebate to remove the lid. Damage to the seals between the lid and the container due to excess force exerted in machine fitting of the lids is avoided by abutments located in the rebate for preventing excess movement of the skirt of the lid. The abutments are discontinuous so that gaps for a levering tool are retained.

10 Claims, 6 Drawing Figures

Figure 1:
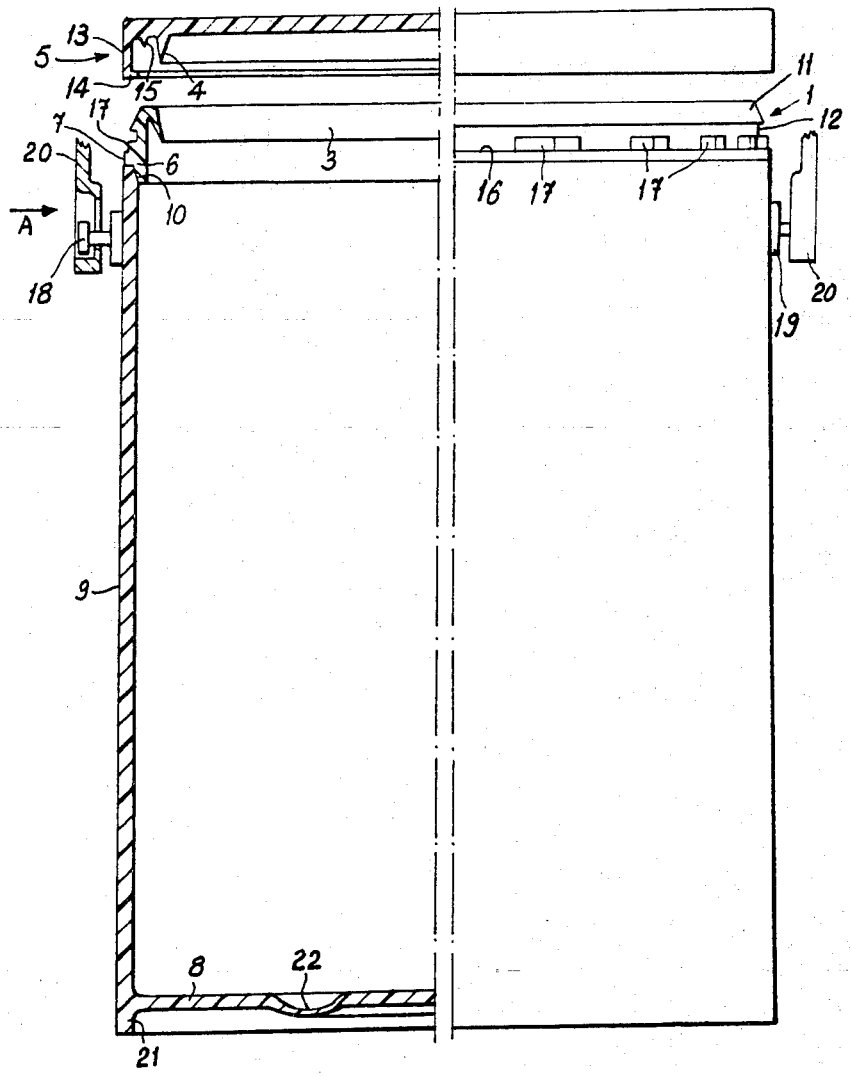

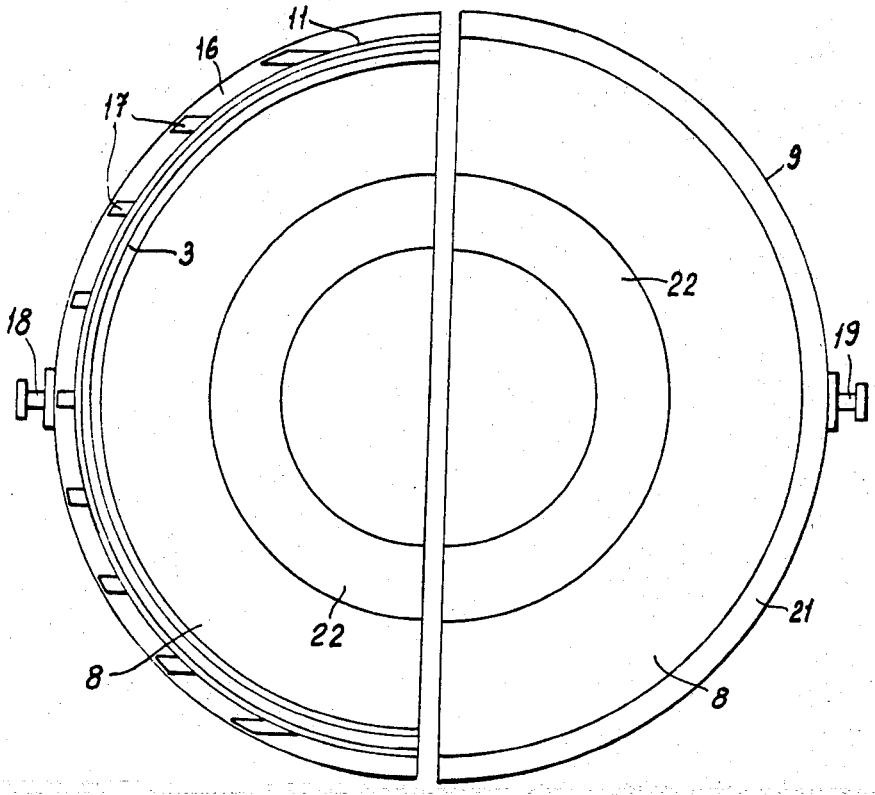
FIG. 4
FIG. 5
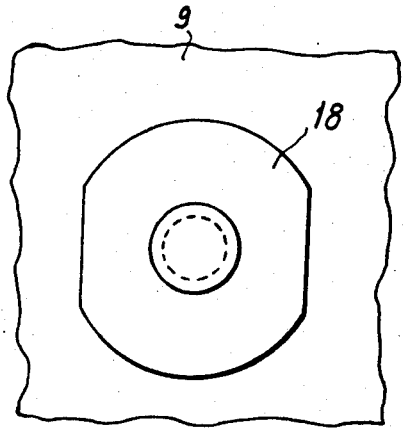
FIG. 6

CONTAINERS

This invention concerns a container and lid combination, of the kind in which the container has a base and a side wall or walls and an open end opposite to the base defined by a peripheral flange extending inwardly with respect to the side wall or walls and downwardly towards the base and the lid has a closure part which is a sealing fit within the flange.

In this specification, the terms 'top', 'bottom', 'upwardly' and 'downwardly' and the like are used for convenience and refer to the container in its usual position of rest on its base, but the terms are not meant to exclude other dispositions of the container for which the usage is inappropriate. 'Inwardly' and 'outwardly' are used with respect to the longitudinal axis of the container.

A common example of a container and lid combination of the kind described is the well-known lever-lid tin in which the said peripheral flange is formed as part of a top ring component secured to the edge of the body of the tin by a rolled seam and the lid is recessed in an inverted hat-shape to provide a closure part to fit within the flange and an outward rim by which the lid can be levered off the tin.

The invention comprises a container and lid combination in which the container has a base, a side wall or walls and an open end opposite to the base defined by a peripheral flange extending inwardly with respect to the side wall or walls and downwardly towards the base, and the lid has a closure part which is a sealing fit within the peripheral flange wherein the container comprises two components each integrally moulded from plastics material and secured together, the said components being a top component including said peripheral flange and having lid-retaining means adjacent to its periphery and independent of the peripheral flange for engaging complementary means on the lid when the closure part of the lid is fitted within the peripheral flange, and a bottom component including the base of the container, at least one of the said components having an integral wall part which comprises the side wall or walls of the container or part of the side wall or walls.

The container of the combination according to the invention can be made simply by separately moulding the top and bottom components, preferably by injection moulding, and then securing them together. This may be done by adhesive or solvent bonding or by thermal welding for thermoplastic materials, for example, spin welding in which frictional heat for welding is generated by relative rotation of the components may be used for containers of circular cross-section.

Preferably, the said integral wall part of one of the components forms the whole or substantially the whole of the side wall or walls of the container so that the joint by which the components are secured together occurs close to the top or bottom of the container. Thus, for example, the bottom component may comprise the base of the container with the integral wall part upstanding from its periphery to form the side wall or walls of the container whilst the top component comprises the said inwardly and downwardly-extending flange and a peripheral seating to receive and be secured to the edge of the upstanding integral wall part.

Preferably, the top component of the container has an upper portion which is rebated with respect to the side wall or walls of the container and the lid has a peripheral skirt to fit over the rebated part so that when the lid is fitted onto the container the lid does not project, or at least not substantially so, beyond the wall or walls of the container in a plane perpendicular to the longitudinal axis of the container.

The lid-retaining means is located on the top component of the container adjacent to its periphery and independent of the inwardly-extending peripheral flange. Suitable means may be an outwardly-facing peripheral groove or bead for engaging, respectively, with an inwardly-facing complementary bead or groove located in a peripheral skirt on the lid. In the arrangement described above where the skirt of the lid is accommodated in a rebate in the upper portion of the top component, then the lid retaining means, for example the aforesaid peripheral groove or bead, is located in the rebate.

An alternative lid-retaining means comprises screw threads on the top component of the container and complementary screw threads on the lid, conveniently located on the aforesaid peripheral skirt.

Supplementary sealing means preferably is provided between the top component of the container and the lid. This may be a narrow bead on the lid or on the top component positioned to be engaged between the lid and the top component in a sealing fit when the lid is fitted on the container with the lid-retaining means engaged.

It is common practice to fit lids on to filled containers mechanically, and it is sometimes difficult to adjust the force used for that purpose to that required just to engage the lid-retaining means. Excessive force can damage the complementary sealing parts of the container and lid, particularly the supplementary sealing means referred to above which is susceptible to damage by crushing if excessive axial force is used to snap on a lid which uses the bead/groove type of retaining means. Any such damage may reduce its ability to retain a sealing fit.

Excessive lid-fitting force may be resisted by providing the top component of the container with an abutment which is positioned to be engaged by the peripheral skirt of the lid if it is forced beyond the position in which the lid-retaining means is engaged.

The abutment may be located in the rebate at the upper portion of the top component of the container at a position just below the peripheral groove or bead of the lid-retaining means. Preferably the abutment is discontinuous so that when the lid is in the fitted position, the lower edge of its peripheral skirt is left exposed at intervals so that a tool such as a screwdriver blade may be applied to that edge for the purpose of levering off the lid.

The container and lid combination according to the invention gives improved sealing of the lid and improved securing of the lid against accidental removal compared with the known lever-lid tins. In the snap-on lid embodiment it preserves the convenience which the user associates with the lever-lid tin in terms of removing and replacing the lid whilst avoiding the distortions to which tin lids are susceptible during repeated removals.

Figure 2:
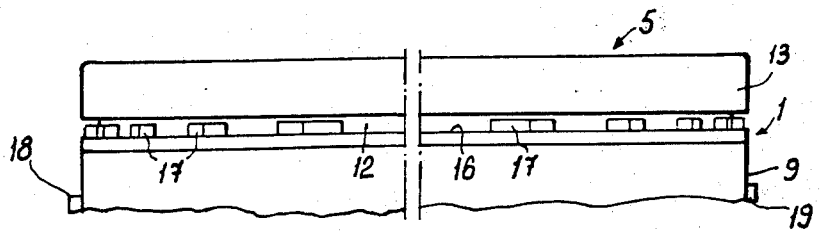
Figure 3:
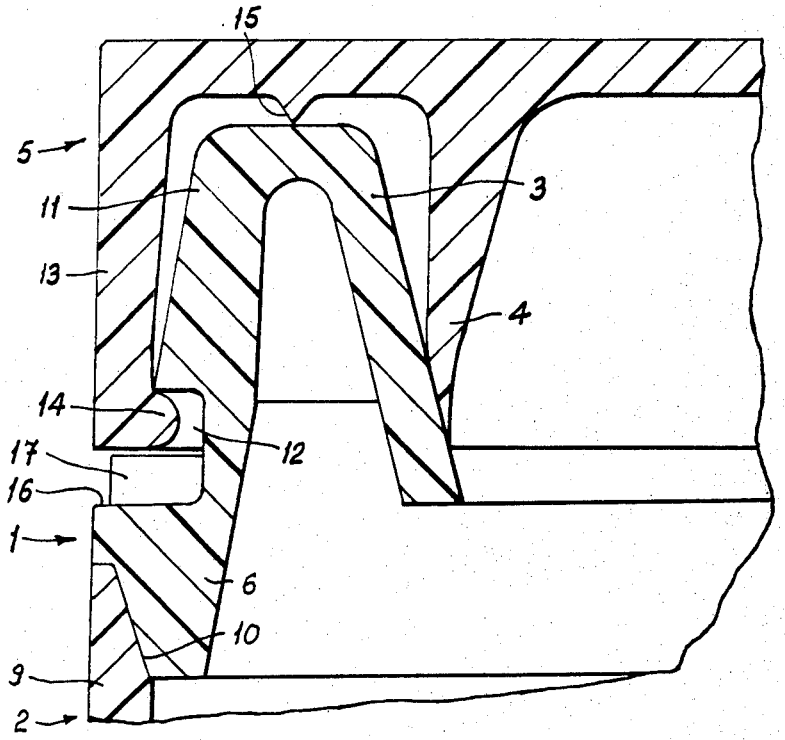

Embodiments of the invention are illustrated by way of example by the accompanying drawings, in which:

FIG. 1 is an elevation, half in section, of a container and its lid, the lid being shown separated from the container, FIG. 2 is a fragmental elevation of the top part of the container of FIG. 1 with its lid in position, FIG. 3 is a fragmental sectional view, on an enlarged scale, showing the engagement of the lid and container of FIG. 1, FIG. 4 is a half plan of the container of FIG. 1 with the lid removed, FIG. 5 is a half inverted plan of the container of FIG. 1, and FIG. 6 is a fragmental view, on an enlarged scale, in the direction of the arrow A in FIG. 1 with the handle omitted.

The container shown in the drawings is circular in plan and comprises a top ring component 1 and a bottom component 2, each moulded in thermoplastics material, for example polypropylene, secured together as will be described by a spun welded joint. The top ring component 1 has an inwardly and downwardly-extending flange 3 around its inner periphery to define the open top of the container and receive the closure part 4 of a lid 5. The top ring component 1 also has a peripheral seating for the top edge of the bottom component, comprising a downwardly-extending tapered spigot 6 and an outward flange 7 to overlie the top edge of the bottom component and give a neat appearance (see FIG. 3).

The bottom component 2 comprises the base 8 of the container and, extending from the periphery of the base 8, the upstanding, substantially cylindrical side wall 9 of the container, the extremity of which is bevelled, as shown by the reference 10, on its inside edge to match the angle of the tapered spigot 6 of the seating on the top ring component.

The two components 1 and 2 are secured together by the method known as spin welding, a form of friction welding. The tapered spigot 6 of the top ring component is entered into the bevelled end of the side wall part 9 of the bottom component, in which it is a snug fit. One component is then rotated at high speed relative to the other whilst pressing the two components together. The heat generated by friction causes the thermoplastics material to soften in the two contacting surfaces. Rotation is then ceased, allowing the softened material of the two surfaces to fuse together, providing a permanent bond on cooling.

Of course, the two components could be secured together by adhesive, by solvent welding or by heat welding according to well-known methods. For these purposes the shape of the tapered spigot 6 and the bevel of the side wall part 9 may be altered or these features may even be omitted.

Instead of forming the side wall of the container as a part of the bottom component 2 it may be formed as a part of the top component 1 and the bottom component may be formed with an upward spigot around its periphery similar to the tapered spigot 6, the two components being secured together by a method similar to one of the methods described above.

In another construction, each of the components 1 and 2 may include a side wall part. Thus the bottom component 2 would have a side wall part of height somewhat less than the desired height of the side wall of the container and the top component would have a complementary side wall part to provide the remainder of the desired height. The two side wall parts would be joined in end-to-end relation, for example by one of the methods described above, their ends being appropriately shaped, for example bevelled, in known manner.

In yet another construction, part of the height of the container side wall or walls may be provided by a sleeve of thermoplastics material to the opposite end of which the components 1 and 2 are secured by a method similar to one of the methods described above.

As shown particularly in FIG. 3, the downward flange forming the closure part 4 of the lid 5 is tapered in section with a feather edge to provide flexibility and good sealing relationship with the inwardly and downwardly-extending flange 3 of the top ring component 1. As previously mentioned and as shown in FIG. 3, the flange forming the closure part 4 is slightly deformed inwardly on engaging the flange 3, being made of diameter slightly greater than the minimum diameter of the latter for this purpose in order to provide good sealing relationship when the closure is in position.

The top ring component 1 is rebated above the flange 7 with a bevelled surface 11 and a peripheral groove 12. The lid 5 has a peripheral skirt 13 at the end of which is an inward bead 14 to ride over the bevelled surface 11 and enter the groove 12, giving snap-on retention of the lid.

Instead of the snap-on arrangement described and illustrated the top ring component may have a rebated part above the flange 7 formed with an external screw thread and the lid may have a skirt with a complementary internal screw thread. Alternatively the top ring component and the lid may have other known complementary features for retaining the lid in position.

Between the skirt 13 and the closure part 4 the lid 5 has a narrow downwardly-projecting annular bead 15 to engage the upper surface of the top ring component 1 in sealing relation when the lid 5 is pushed fully home on the container.

Around the shoulder 16 defining the lower edge of the peripheral groove 12 of the top ring component 1 are a plurality of spaced abutments 17 of height somewhat less than the difference between the depth of the peripheral groove 12 and the depth of the inward bead 14 of the lid. As shown in FIGS. 2 and 3, these abutments 17 are clear of but very close to the bottom edge of the skirt 13 of the lid when the latter is pushed fully home on the container. However, if excessive force is applied to push the lid 5 on to the container, the edge of the skirt 13 will engage the abutments 17 to resist the force and thus reduce the possibility of crushing or otherwise damaging the narrow annular bead 15 which could lead to failure of the bead 15 to seal against the top ring component 1 when the force is removed.

It will be understood that the same resistance to excessive force could be provided by reducing the depth of the peripheral groove 12 to a dimension only slightly greater than the depth of the bead 14. However, this would lead to difficulty in removing the lid, for which it is necessary to insert a tool into the groove 12 to disengage the bead 14 from the groove. The plurality of spaced abutments could be replaced by one or more part-circular abutments extending around a sector or sectors of the shoulder 16 and leaving a space or spaces into which a tool can be inserted. The abutments 17 shown are, however, preferred, since they permit a tool to be inserted succesively at different positions between them for progressive disengagement of the bead 14 from the groove 12.

Buttons 18, 19 having headed projections are secured at diametrically-opposite positions to the outer surface of the side wall 9 of the container near its top edge to receive the ends of a bale handle 20 which pivotally engage the headed projections.

As shown in FIGS. 1, 4 and 5, the base 8 of the container is supported by a base rim 21 which holds the base clear of any flat surface on which the container is stood. A ring-shaped moulding 22, concentric with the longitudinal axis of the container, is formed in the base 8 in order to reduce the stresses which are set up in the base during the moulding process.

What is claimed is:

1. A container and lid combination in which the container has a base, a side wall or walls and an open end opposite to the base defined by a peripheral flange extending inwardly with respect to the side wall or walls and downwardly towards the base, and the lid has a closure part which is a sealing fit within the peripheral flange wherein the container comprises two components each integrally moulded from plastics material and secured together, the said components being a top component including said peripheral flange and having lid-retaining means adjacent to its periphery and independent of the peripheral flange for engaging complementary means on the lid when the closure part of the lid is fitted within the peripheral flange, and a bottom component including the base of the container, at least one of the said components having an integral wall part which comprises the side wall or walls of the container or part of the side wall or walls.

2. A container and lid combination as claimed in claim 1, wherein the lid-retaining means of the top component of the container is an outwardly-facing peripheral groove or bead and the complementary means on the lid is a peripheral skirt with an inwardly-facing bead or groove for engaging, respectively, the peripheral groove or bead of said top component.

3. A container and lid combination as claimed in claim 1 or claim 2, wherein the closure part of the lid comprises a downwardly-extending flange which fits closely within the inwardly and downwardly-extending peripheral flange of the container.

4. A container and lid combination as claimed in claim 3, wherein at least one of the closure flange on the lid and the peripheral flange on the container is resiliently deformable, and said flanges are shaped and dimensioned to provide a sealing fit by virtue of such resilient deformation when the lid is fitted on the container.

5. A container and lid combination as claimed in claim 4, wherein the closure flange on the lid is tapered outwardly towards its free edge and is dimensioned so that during fitting of the lid said free edge at least initially engages the peripheral flange on the container at a location outwardly from the free edge of the peripheral flange.

6. A container and lid combination as claimed in claim 1, further comprising supplementary sealing means between the top component of the container and the lid.

7. A container and lid combination as claimed in claim 6, wherein the supplementary sealing means is a narrow bead on the lid or on the top component of the container positioned to be engaged between the lid and said top component in a sealing fit when the lid is fitted on the container with the lid-retaining means engaged.

8. A container and lid combination as claimed in claim 7, wherein the lid-retaining means of the top component of the container is an outwardly-facing peripheral groove or bead and the complementary means on the lid is a peripheral skirt with an inwardly-facing bead or groove for engaging, respectively, the peripheral groove or bead of the top component, said top component being provided with an abutment which is positioned to be engaged by the peripheral skirt of the lid if, during fitting, the lid is forced beyond the position in which the lid-retaining means is engaged.

9. A container and lid combination as claimed in claim 8, in which the abutment is discontinuous around the top component of the container.

10. A container and lid combination as claimed in claim 2, wherein the upper portion of the top component of the container is rebated to accommodate the peripheral skirt of the lid so that the lid does not project, or does not project to any substantial extent, beyond the container wall or walls in a plane perpendicular to the longitudinal axis of the container.

* * * * *